US006102736A

United States Patent [19]

Leeb

[11] Patent Number: 6,102,736

[45] Date of Patent: Aug. 15, 2000

[54] METHOD AND DEVICE FOR PREVENTING CORROSION OF ELECTRICAL CONNECTORS

[75] Inventor: Karl-Erik Leeb, Lillebo, Sweden

[73] Assignee: Telefonaktiebolaget LM Ericsson, Stockholm, Sweden

[21] Appl. No.: 09/089,454

[22] Filed: Jun. 3, 1998

[30] Foreign Application Priority Data

Jun. 3, 1997 [SE] Sweden ..... 9702103

[51] Int. Cl.[7] ..... H01R 33/945

[52] U.S. Cl. ..... 439/577; 219/209

[58] Field of Search ..... 219/209, 210; 439/577

[56] References Cited

U.S. PATENT DOCUMENTS 5,132,874 7/1992 Chandler et al. ..... 361/386

5,580,275 12/1996 Bozek ..... 439/577

FOREIGN PATENT DOCUMENTS 1394302 5/1988 U.S.S.R. .

1523130 8/1978 United Kingdom .

*Primary Examiner*—Lincoln Donovan

*Assistant Examiner*—Javid Nasri

*Attorney, Agent, or Firm*—Burns, Doane, Swecker & Mathis, L.L.P.

[57] ABSTRACT

The present invention relates to a method and device for functional protection of connectors where a heat-emitting means heats contact pins while certain selected parts of the pins are preferably covered with heat-insulating material (12) which furthermore can be contamination- and gas-tight. In this way contamination of the contact pins and condensation of moisture is counteracted which leads to a longer life because of less corrosion and leakage currents being prevented. These problems are specially common in connectors for electronic constructions which are cooled with exterior air and/or are used outdoors.

36 Claims, 2 Drawing Sheets

METHOD AND DEVICE FOR PREVENTING CORROSION OF ELECTRICAL CONNECTORS

FIELD OF THE INVENTION

The present invention relates to a method and device for function protection in electrical connectors.

STATE OF THE ART

An electrical connector consists in principle of two main parts, the part or the parts which the connector pins are arranged in and which is called the male contact or male connector, and the part or the parts where the connection holes corresponding to the contact pins are arranged and which is called the female contact or female connector. The respective female contacts each form a housing for a respective male contact.

During the use of connectors for electronic constructions, especially outdoors or with cooling with exterior air, there often exist problems with damage and deficient functions caused by corrosion of the metal parts such as contact pins and problems with leakage currents between the different metal parts. Often there exist a requirement for compact constructions with a large number of connector pins placed at a short distance from each other which further increases said problems. In existing arrangements which are used outdoors one often tries to seal the two contact halves with the help of rubber gaskets and the connector is then given a cylindrical shape. This leads to the problem that the construction becomes bulky and space demanding, especially in applications which require that a large number of contact pins be used, for example in telecommunication and computer equipment.

The rubber gaskets used cause problems since they do not completely seal against the diffusion of moisture wherefore moisture condenses around the contact pins. Furthermore, leakage increases as a consequence of the ageing of the rubber.

Noble metal coatings are expensive and often do not have the resilient characteristics which are required for contact pins and housings. The combination of noble metals and good resilient material made of non-noble metals can cause electrolytic voltage differences if they are surrounded by condensed water films. Plating with noble metals is often not completely sealed especially after being used for a time and the problem of the above mentioned type often occur then. In, for example, telecommunication equipment a problem-free function time of 20 years is required, which is difficult to achieve with established techniques.

The present invention solves this problem in a simple way at the same time as it permits a compact construction and it is shown in the following preferred examples of embodiments with reference to the accompanying figures.

DISCLOSURE OF THE INVENTION

The present invention tackles a problem with damage and deficient functional security which is caused by the corrosion of metal parts in connectors.

The present invention also gives a solution to the problem of leakage currents between the different metal parts of connectors.

The present invention also provides a solution to the problems which occur in non-airtight connectors where moisture and contamination come into the connector. For example it solves the problems which occur during the use of rubber gaskets and rubber seals in connectors as a consequence of ageing of the material.

The problem of constructing connectors that are easier to handle and require less space, especially connectors which comprise a large number of contact pins, can be adequately addressed by the present inventive concept.

The present invention simplifies the choice of material during constructional work through that cheaper materials with better durability and resilient properties than the metals and alloys which earlier have been used can be considered.

Furthermore, the present invention tackles the problem which occur as a consequence of continuous condensed water films in connectors. One such example is electrolytic potential differences.

An object with the present invention is to prevent the occurrence of-damage and deficient functional security which is caused by the corrosion of metal parts in connectors.

Another object with the present invention is also to prevent the occurrence of leakage currents between the different metal parts of connectors.

Another object with the present invention is to offer connectors with a longer life.

Another object with the present invention is to prevent moisture and contaminants penetrating into the connector and to offer an alternative to the use of rubber gaskets and rubber seals as seals in connectors.

A further object with the present invention is to offer a more easily handled and less space requiring connector, especially in connectors which comprise a large number of contact pins.

An object with the present invention is to facilitate the choice of material during the constructional work through that cheaper materials with better durability and resilient characteristics than the metals and alloys which have earlier been used can be considered. Thereby the object of being able to make cheaper connectors is also achieved.

Furthermore it is an object with the present invention to eliminate the risk for the occurrence of continuous condensed water films which can cause electrolytical potential differences in connectors.

In short the invention solves these problems by providing a heat-emitting means being arranged so that it warms up the contact pins, preferably the parts which are inside the contact housing.

Described in more detail the inventive method and the inventive device solve the problems put forward in a contact housing in which a row of contact pins are mounted in a circuit board. In the contact housing is a heating means which comprises a heat-transmitting means, arranged in the vicinity or in direct contact with the contact pins, a heat-emitting means and associated printed conducting patterns and contact surfaces. An applied voltage drives a current through the heat-emitting means which warms up the heat-transmitting means. The heat thereby supplied raises the temperature in the parts which are surrounded by the contact housing whereby the contact pins obtain a higher temperature than the surrounding air. Selected parts of the contact pins can be heat insulated. The device can also be provided with a control circuit for controlling the power to the heat-emitting means whereby the temperature and/or relative air humidity in the contact housing can be regulated.

One of the advantages which are obtained with the inventive device and method are increased operation and function security of the connector.

Another important advantage with the inventive device and method is that the connectors with an increased life are obtained.

The possibilities which the inventive method gives for constructing cheaper, more compact and more easily handled connectors is a considerable advantage in comparison with the known techniques in the field.

The present invention also offers increased freedom of choice of material which is advantageous partly from a cost point of view partly from wear, durability and resilience reasons.

The present invention offers also increased sealing, especially in the long term because rubber seals and rubber gaskets can be avoided. Through moisture and contaminants not being able to come inside corrosion and leakage currents in a connector according to the inventive concept are militated against.

The invention will now be described more closely with the help of preferred embodiments and with reference to the accompanying drawings.

PREFERRED EMBODIMENTS

Figure 1A:
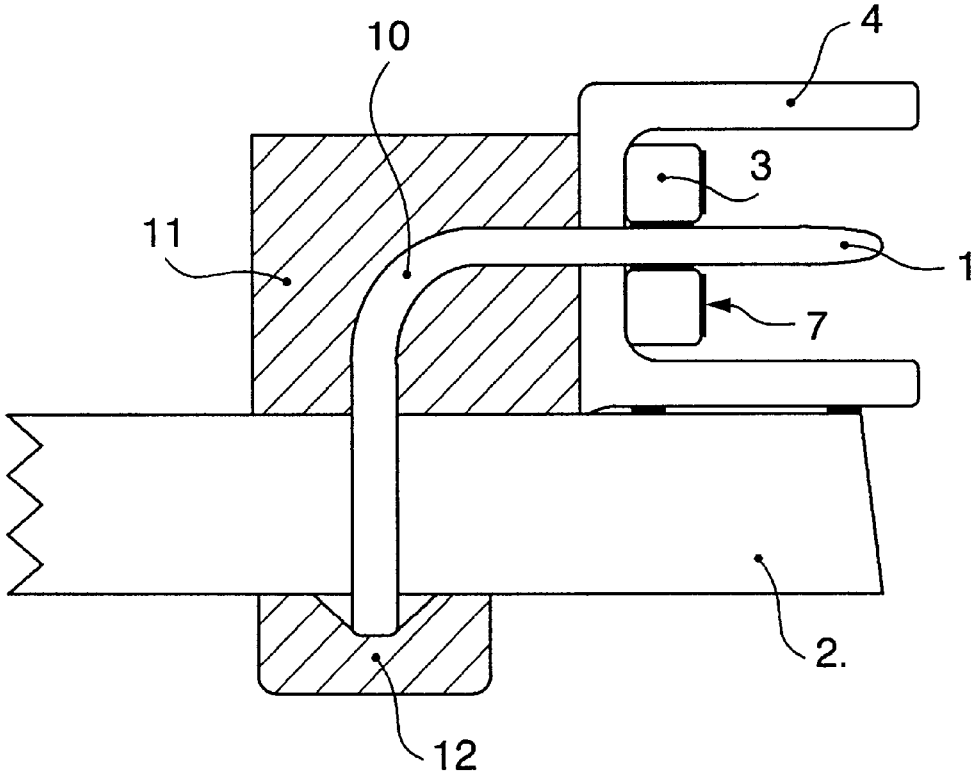
FIG. 1*a* shows a cross section of the first preferred embodiment of the invention.
Figure 1B:
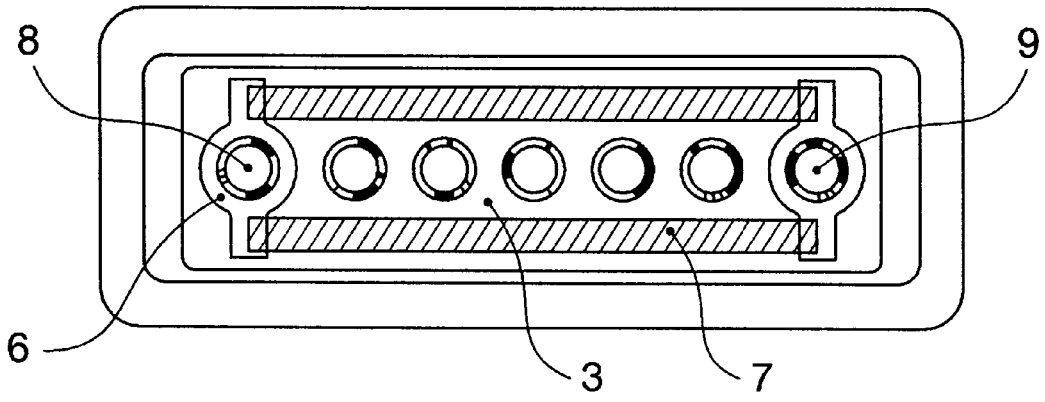
FIG. 1*b* shows another view of the first preferred embodiment of the invention, more exactly a view of the invention seen in the direction in towards the contact pins comprised in the invention.

FIGS. 1*a* and 1*b* show different views of a first preferred embodiment of the invention, in which a row of contact pins 1 are mounted in a circuit board 2 and in a contact housing 4. In the bottom of the contact housing 4 and threaded onto the contact pin 1 is a heating means which comprises a heat-transferring means 3 which is manufactured in some suitable material, for example some type of plastic or a ceramic material, with a row of holes fitting on the contact pins 1 and with a printed circuit pattern consisting of contact surfaces 6 and resistors 7 forming a heat-emitting means. The contact surfaces 6 are soldered to the outer contact pins 8 and 9 which are connected to a voltage and to earth respectively. The supplied voltage drives a current through the resistors 7 which warm up the heat-transmitting means 3. The thereby supplied heat raises the temperature in the parts which are surrounded by the contact housing 4 whereby the contact pins 1 obtain a higher temperature than the surrounding air. This acts against corrosion and leakage currents amongst others through that continuous films of condensed water never form.

In order to further improve the effect the parts 10 of the contact pins 1 which are situated outside the contact housing 4 can be insulated with a heat-insulating material 11 12, for example foamed polythene. This action reduces the heat losses and is especially advantageous and desirable when it concerns the free surfaces of the contact pins 1 which are in a space which contains heat-sensitive electronic components, which space should be held at an even and low temperature relative to the space's environment. In this space no extra additional heat is desired. An advantage of covering these free surfaces is that the coating prevents contaminants fastening on and between the pins and that aggressive gases are prevented from coming into contact with the metal surface. The covering should therefore consist of material which is contaminant or gas tight alternatively both gas- and contaminant-tight.

The contact housing shown in (FIGS. 1*a* and 1*b*) is connected to corresponding parts, the so-called female connector, which can be protected from heat losses in the same way as described above, in that all the constituent critical contact pins 1 and corresponding female parts obtain a temperature higher than the surroundings.

However, a temperature that is too high can also bring about other types of corrosion wherefore the rise should not be too great. In the simplest embodiment the resistor 7 is therefore adapted so that a temperature increase of approximately 10° C. is obtained.

In an embodiment, not shown, the contact surfaces 6 are designed as a circuit pattern comprising a temperature sensor for sensing the temperature at a measuring point in the contact housing 4, and a regulator circuit which compares the measured signal from another temperature sensor arranged at a measuring point outside the contact housing 4. The temperature between these measuring points is held constant.

In another embodiment not shown one or several sensors for sensing the relative air humidity in the contact housing are enclosed. A regulator circuit regulates the power to the heat-emitting means so that the relative air humidity in one or several sensitive parts of the contact housing is not permitted to rise over a certain value which can be selected in the interval of 30–50%, as no mentionable corrosion occurs in this interval for the materials which are nonmally present in the contact pins 1.

Alternatively the surrounding temperature can be measured and the pins heated to a temperature which is 10 to 30° C. higher than this. This means according to the physical gas laws that the relative air humidity sinks to the value where the risk for corrosion is little or none.

The skilled man has the possibility to experiment to find a suitable placement of the different sensors depending on the circumstances, for example type of sensor, shape and size of the contact housing, etc. The circuit for regulating the temperature or air humidity can also be placed on the circuit board 2.

Figure 2:
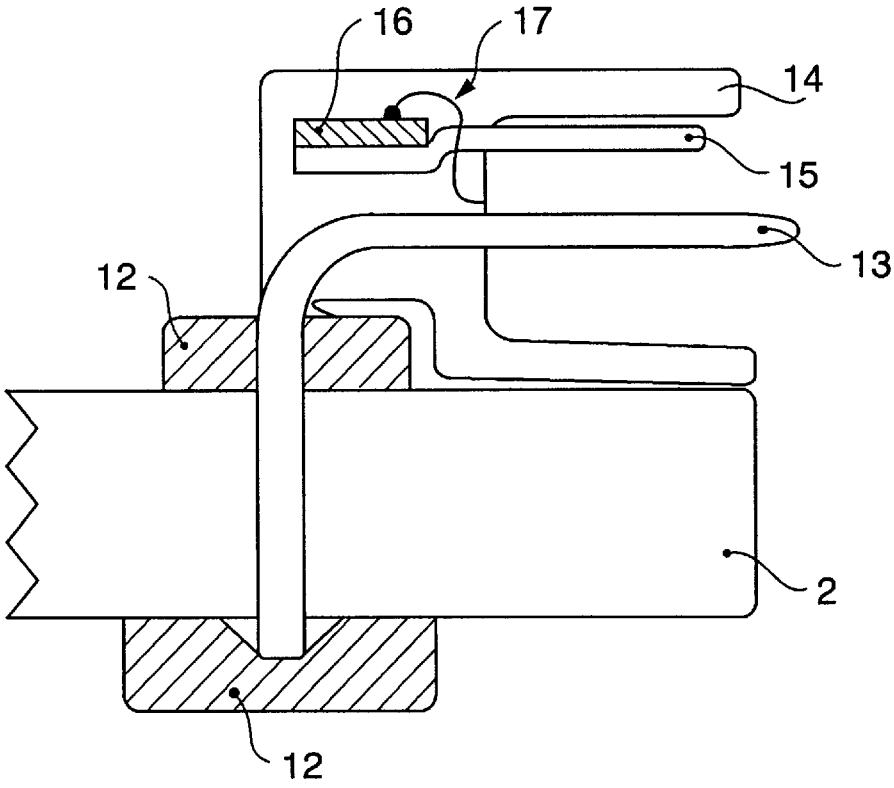
FIG. 2 shows a cross section of a second embodiment according to the invention.

FIG. 2 shows a second embodiment of the invention, in which the contact pins 13 are surrounded by a contact housing 14, which also includes a heat-transmitting means 15 of material with good heat-conducting properties. By good heat-conducting properties it is understood to mean a material having a heat-conduction coefficient which is not less than 15 W/m° K. Aluminium oxide is one such material but also other types of ceramics fulfil this requirement. On the heat-transmitting means 15 is arranged a printed circuit with resistors forming heat-emitting means 16. The heat-transmitting means 15 and heat-emitter means 16 are cast in the contact housing 14. The heater which consists of the heat-transmitting means 15 and the heat-emitting means 16 is in this embodiment placed in the immediate vicinity of the contact pins 13. The heat-transmitting means 15 is specially designed in order to come into direct contact with the air in the cavity in the contact housing 14 which the contact pins are in. Corrosion and leakage currents occur in the case that a female contact which is connected to the contact housing 14 and the contact pins 13 leave an air space between the female contact and the contact housing so that the air in this air space comes into contact with contact pins 13. Through designing the heat-transmitting means 15 so that it completely or partially projects out into said cavity or has a surface coming into contact with the air in said cavity the contact pins and the air can be heated up to suitable temperatures. The means 15 can, for example, be designed as a plate, one surface of which extends along the contact pin 13 in the cavity. The means 15 can also be designed with pins which projects out in the cavity. It is important that the heat-transmitting means 15 is designed so that the female contact connection is not obstructed. The female contact can also be adapted and designed with grooves which fit on means 15 so that the connection of the female contact is not obstructed.

Voltage supply to the heat-emitting means 16 is arranged via electrical conductors 17 from two of the contact pins 13 which are connected to the voltage respective earth. In analogy with the earlier shown embodiments the free surfaces are covered with a heat-insulating material 12. In this way the object of keeping the energy losses low is obtained which means that energy is not wasted. By the free surfaces is meant the parts of the contact pins 13 which are not covered by the male or female connectors' contact houses.

Figure 3:
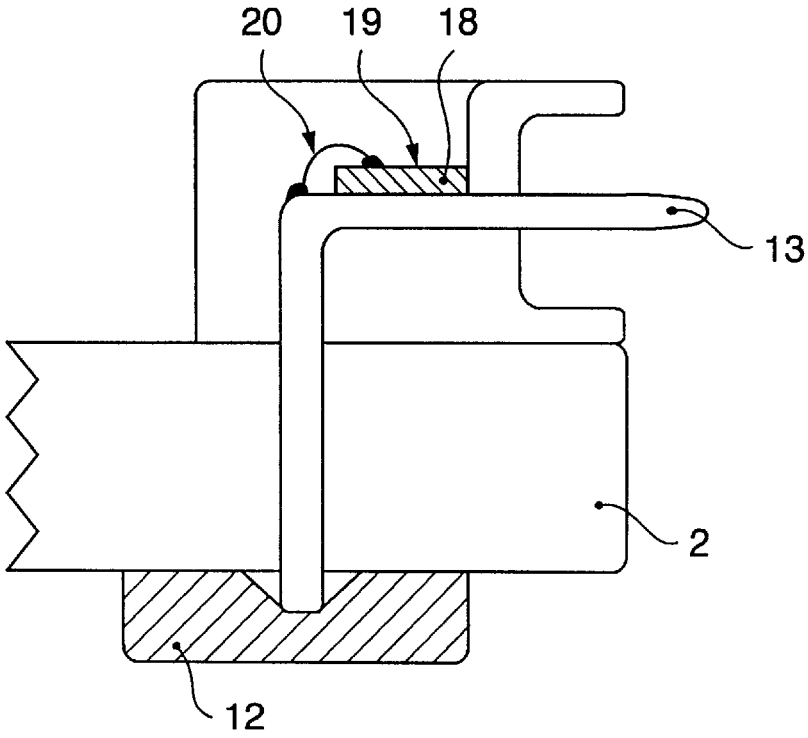
FIG. 3 shows a cross-section of a third embodiment of the invention.

FIG. 3 shows a third embodiment of the invention in which the contact pins 13 are heated via a heat-transmitting means 18 which is arranged in direct contact with the contact pins 13. The heat-transmitting means 18 consists of an electrically insulating material. The heat-emitting means 19 is formed of a printed circuit 19 which is connected to an electrical voltage via the conductors 20. The contact pins' 13 free surfaces are covered with heat-insulating material 12 in analogy with the earlier shown embodiments. One of the advantages with this embodiment is that the heater is not in the cavity for the contact pins. This embodiment therefore is suitable for the female contact embodiment where the female contact fills the hole of the cavity in the contact housing 4. Another advantage is that the heat-conducting track between the heat-emitting means 19 and the contact pins can be made short. The only limitation for how short the tracks can be made is the electrical insulating material's dielectric constant which determines how thin the means 18 can be made without a flash-over occurring between the contact pins 13 and the heat-emitting means 19.

The invention is naturally not limited to the embodiments described above and shown in the drawings but can be modified within the scope of the accompanying claims.

What is claimed is:

1. A method for preventing the formation of corrosion and leakage currents in an electrical connector, the electrical connector comprising at least one electrical contact and a contact housing, the method comprising:

providing the connector with a heat emitting member in the vicinity of the at least one electrical contact; and heating the at least one electrical contact by supplying the heat emitting member with electrical current; and regulating the supplied electrical current such that a temperature difference measured between a measuring point located inside the contact housing and a measuring point located outside the contact housing is maintained substantially constant.

2. The method of claim 1, further comprising:

providing the heat emitting member with resistive components; and delivering an electrical current through the resistive components.

3. The method of claim 2, further comprising:

connecting the electrical connector to an external electrical device; and drawing electrical current from the at least one electrical contact for delivery through the resistive components.

4. The method of claim 1, further comprising:

arranging the heat-emitting member within the contact housing and heating the at least one electrical contact with the heat-emitting member within the contact housing.

5. The method of claim 1, further comprising:

providing at least a portion of the electrical contact outside of the contact housing; and covering the portion of the electrical contact extending outside of the contact housing with an insulating material.

6. The method of claim 1, wherein the electrical contact comprises a contact pin.

7. The method of claim 1 wherein the temperature difference is within a range of 10° C. to 30° C.

8. A method for preventing the formation of corrosion and leakage currents in an electrical connector, the electrical connector comprising at least one electrical contact and a contact housing, the method comprising:

providing the connector with a heat emitting member in the vicinity of the at least one electrical contact; and heating the at least one electrical contact by supplying the heat emitting member with electrical current; and regulating the supplied electrical current such that the relative air humidity within the contact housing is maintained below a predetermined threshold value.

9. The method of claim 8, wherein the threshold relative humidity value is between 30–50%.

10. The method of claim 8, further comprising:

providing the heat emitting member with resistive components; and delivering an electrical current through the resistive components.

11. The method of claim 10, further comprising:

arranging the heat-emitting member within the contact housing and heating the at least one electrical contact with the heat-emitting member within the contact housing.

12. The method of claim 8, further comprising:

arranging the heat-emitting member within the contact housing and heating the at least one electrical contact with the heat-emitting member within the contact housing.

13. The method of claim 8, further comprising:

providing at least a portion of the electrical contact outside of the contact housing; and covering the portion of the electrical contact extending outside of the contact housing with an insulating material.

14. The method of claim 8, wherein the electrical contact comprises a contact pin.

15. An apparatus for preventing the formation of corrosion and leakage currents in an electrical connector comprising:

a contact housing member;

at least one electrical contact disposed at least partially within the contact housing;

a heat-emitting member disposed in the vicinity of the at least one electrical contact; and temperature sensors arranged inside and outside of the contact housing, the sensors connected to a regulator circuit which regulates power delivered to the heat-emitting member in response to a difference in temperature measured by the temperature sensors inside and outside of the contact housing such that the temperature inside the contact housing is maintained at a temperature which is higher than the temperature outside of the contact housing by a predetermined amount.

16. The apparatus of claim 15, wherein the heat-emitting member is formed from a material having good heat-conducting properties.

17. The apparatus of claim 16, wherein the heat-emitting member comprises a plurality of holes adapted to receive a plurality of contact pins.

18. The apparatus of claim 15, wherein the heat-emitting member comprises at least one resistive component.

19. The apparatus of claim 15, wherein the heat emitting member is connected to the at least one electrical contact, the electrical contact adapted to be connected to an external source of electrical power.

20. The apparatus of claim 15, wherein the heat-emitting member is arranged within the contact housing and in the immediate vicinity of the at least one electrical contact.

21. The apparatus of claim 15, wherein the heat-emitting member is arranged within the contact housing and in direct contact with the at least one electrical contact.

22. The apparatus of claim 15, wherein at least a portion of the at least one electrical contact is located outside of the contact housing, that portion located outside of the contact housing being covered by an insulating material.

23. The apparatus of claim 22, wherein the insulating material is gas-or-contamination tight.

24. The apparatus of claim 15, wherein the at least one electrical contact comprises a contact pin.

25. The apparatus of claim 15, wherein the predetermined amount lies within a range of 10–30° C.

26. An apparatus for preventing the formation of corrosion and leakage currents in an electrical connector comprising:

a contact housing member;

at least one electrical contact disposed at least partially within the contact housing;

a heat-emitting member disposed in the vicinity of the at least one electrical contact; and a relative air humidity sensor disposed inside the contact housing, the sensor connected to a regulator circuit which regulates power delivered to the heat-emitting member in response to the relative humidity measured by the sensor such that the relative humidity inside the contact housing is maintained below a threshold value.

27. The apparatus of claim 26, wherein the threshold value is 30–50% relative humidity.

28. The apparatus of claim 26, wherein the heat-emitting member is formed from a material having good heat-conducting properties.

29. The apparatus of claim 28, wherein the heat-emitting member comprises a plurality of holes adapted to receive a plurality of contact pins.

30. The apparatus of claim 26, wherein the heat-emitting member comprises at least one resistive component.

31. The apparatus of claim 26, wherein the heat emitting member is connected to the at least one electrical contact, the electrical contact adapted to be connected to an external source of electrical power.

32. The apparatus of claim 26, wherein the heat-emitting member is arranged within the contact housing and in the immediate vicinity of the at least one electrical contact.

33. The apparatus of claim 26, wherein the heat-emitting member is arranged within the contact housing and in direct contact with the at least one electrical contact.

34. The apparatus of claim 26, wherein at least a portion of the at least one electrical contact is located outside of the contact housing, that portion located outside of the contact housing being covered by an insulating material.

35. The apparatus of claim 34, wherein the insulating material is gas-or-contamination tight.

36. The apparatus of claim 26, wherein the at least one electrical contact comprises a contact pin.

* * * * *